US006739681B1

(12) United States Patent
Sharrow

(10) Patent No.: US 6,739,681 B1
(45) Date of Patent: May 25, 2004

(54) ERGONOMICALLY ADJUSTABLE CONTROL PANEL AND METHOD

(75) Inventor: John A. Sharrow, Redmond, WA (US)

(73) Assignee: Equator Corporation, Houston, TX (US)

( * ) Notice: Subject to any disclaimer, the term of this patent is extended or adjusted under 35 U.S.C. 154(b) by 209 days.

(21) Appl. No.: 10/054,408

(22) Filed: Jan. 22, 2002

(51) Int. Cl.[7] ..... A47B 88/00
(52) U.S. Cl. ..... 312/327; 312/279
(58) Field of Search ..... 312/278, 279, 312/326, 327, 297, 300, 313, 317.1

(56) References Cited

U.S. PATENT DOCUMENTS

| | | | | | |
|---|---|---|---|---|---|
| 4,250,865 | A | * | 2/1981 | Scherer | 312/323 |
| 4,268,098 | A | * | 5/1981 | Kretchman et al. | 312/210 |
| 4,288,133 | A | * | 9/1981 | Deatherage | 312/279 |
| 5,738,424 | A | * | 4/1998 | Katz et al. | 312/223.1 |
| 5,862,468 | A | * | 1/1999 | Kim | 312/7.1 |
| 6,119,678 | A | | 9/2000 | Marchand | |
| 2001/0008237 | A1 | * | 7/2001 | Essig | 219/482 |

FOREIGN PATENT DOCUMENTS

| | | | |
|---|---|---|---|
| DE | 003330587 | * | 3/1985 |
| DE | 004113552 | * | 10/1992 |

* cited by examiner

*Primary Examiner*—Lanna Mai
*Assistant Examiner*—Hanh V. Tran
(74) *Attorney, Agent, or Firm*—Kenneth L. Nash

(57) ABSTRACT

Assemblies and methods are provided that address ergonomic problems by providing a support member for adjusting the operating angle of the control panel to optimize the position thereof for personal requirements of individual users. The assembly also provides a robust construction that is even reliable for use on appliances such as laundry appliances that are subject to relatively high vibrations during operation. The assembly provides a recess in the appliance housing that mates to the shape of the control panel to thereby provide a prone setting which minimizes the packaged volume of the machine, with a resulting savings in the cost of packaging and shipping.

17 Claims, 2 Drawing Sheets

ERGONOMICALLY ADJUSTABLE CONTROL PANEL AND METHOD

TECHNICAL FIELD

The present invention relates generally to appliances and, more particularly, to an adjustable control panel especially suitable for reliable operation of appliances having relatively high vibration characteristics such as laundry machines.

BACKGROUND ART

The control panel preferably houses and protects switches, indicators, and other devices and the associated wiring. It would be desirable to mount the panel on the machine in a location and position that is convenient and accessible to all users. However, the location and position for the typical control panel have been in the past, of necessity, a compromise that best suits the "average" user.

Current generation appliances may employ electronic displays and switches that are best viewed and accessed from more limited angles than older electromechanical devices. Users with physiological characteristics that differ from the "average" in height, reach, and other factors may experience difficulty and may even suffer stress injuries when trying to use such appliances. While pivotal panels have been utilized in the prior art, such panels have had numerous problems that are discussed in more detail hereinafter. For instance, the below discussed patent discloses a moveable or rotatable panel that still projects upwardly from the back of the machine even after being folded downwardly. Other problems relate to reliability as will be discussed hereinafter.

Home appliances, and in particular laundry machines such as washers and dryers, typically have user controls clustered together on a panel. Often, the control panel projects upwardly from the body of the machine on the rear side of the machine. The projection of the panel from the body creates space within the shipping box that adds shipping costs by increasing the volume of the shipping container and reducing the number of units that can be shipped in a given volume. The consumer therefore must pay extra shipping costs, of approximately fifteen percent, due simply to the projecting panel. Moreover, the shipping box requires extra box stuffing material, such as Styrofoam, that may create waste problems, may not be biodegradable, may pollute the environment, and may unnecessarily fill up land fills.

Thus, previous attempts to solve some of the aforementioned problems include the following patent:

U.S. Pat. No. 6,119,678, issued Sep. 19, 2000, to B. F. Marchand, discloses an appliance, such as a cooking range, a clothes dryer, a clothes washer, an oven or the like, includes a console along a rear edge of the appliance which can pivot between an upright in-use position and a lower shipping, repair and/or servicing position. The console is preferably of a two-part construction including a front housing body having an integral injection molded encapsulation or frame peripherally retaining a touch sensor control panel which can be readily accessed when the console is in its lower repair position.

Consequently, there remains a need to provide an improved ergonomic control panel that may lower costs and still reliably operate for many years of service even on machines that produce significant vibration. Those of skill in the art will appreciate the present invention which addresses the above problems, and other significant problems uncovered by the inventors the solutions to which are discussed hereinafter.

SUMMARY OF THE INVENTION

Accordingly, it is an objective of the present invention to provide an improved assembly and method for mounting a control panel to an appliance.

An objective of one preferred embodiment of the present invention is to provide a control panel that may be adjusted in position according to the individual needs of any particular operator.

An objective of another embodiment of the present invention is to provide a mounting that reliably holds the control panel in the desired position even in the presence of prolonged vibrations over many years.

An objective of another particular embodiment of the present invention is to provide a control panel mounting that is collapsible to a substantially flat position with respect to the appliance housing to thereby provide lower packing and shipping costs.

These and other objectives, features, and advantages of the present invention will become apparent from the drawings, the descriptions given herein, and the appended claims. However, it will be understood that above-listed objectives and/or advantages of the invention are intended only as an aid in understanding aspects of the invention, are not intended to limit the invention in any way, and therefore do not form a comprehensive or restrictive list of objectives, and/or features, and/or advantages.

Accordingly, an appliance assembly is provided that may comprise one or more elements such as, for instance, an appliance housing, a control panel housing, and/or at least one pliable member having a first side and a second side. The first side of the pliable member may be affixed to the appliance housing and the second side may be affixed to the control panel housing such that the control panel housing is moveable or rotatable with respect to the appliance housing. The pliable member may be elongate and may be affixed to most of a length of the control panel housing.

The assembly may further comprise at least one support member, such a rod, mounted between the control panel housing and the appliance housing operable for affixing the control panel housing at a desired moveable position with respect to the appliance housing.

The support member may, in a presently preferred embodiment, be pivotally attached to the control panel housing. Other elements may comprise at least one clamp operable for clamping the at least one support member in a selected position to thereby affix the control panel at the desired position. In one embodiment, the at least one clamp is secured to the appliance housing.

The assembly may further comprise features such as the appliance housing defining a recess adjacent the pliable member, and the control panel having a selected shape to mate with the recess such that the control panel housing is moveable or rotatable into the recess for reducing a total volume of the combined appliance housing and control panel housing.

One possible method of the invention for mounting a control panel housing with respect to an appliance housing may comprise one or more steps such as, for instance, flexibly connecting the control panel housing to the appliance housing through a flexible member, providing a recess within the appliance housing that mates to a shape of the control panel housing such that the control panel is moveable or rotatably insertable into the recess, and/or providing a control that either permits moveable or rotatable movement of the control panel housing with respect to the appliance housing or affixes the control panel in a selectable position with respect to the appliance housing.

Other steps might include attaching the first side of a pliable member to the control panel housing, and attaching the second side of the pliable member to the appliance housing. In one embodiment, the method may further comprise providing the pliable member to be elongate in that the pliable member has a width less than one-fifth of its length.

Other steps may comprise providing one or more rigid members attachable between the control panel housing and the appliance housing to rigid support the control panel housing in the selected position and/or providing one or more clamps for selectively gripping the one or more rigid members and/or affixing the one or more clamps to the appliance housing and/or providing a pivotal or rigid connection on a first end of the one or more rigid members.

In another embodiment, a method for selectively and securely controlling a position of a control panel housing with respect to an appliance housing which vibrates during operation may comprise one or more steps such as flexibly connecting the control panel housing to the appliance housing utilizing a flexible member, providing one or more rigid members attachable between the control panel housing and the appliance housing to rigidly support the control panel housing in the selected position, providing one or more clamps for selectively gripping the one or more rigid members, affixing the one or more clamps to the appliance housing, and providing a pivotal connection on a first end of the one or more rigid members.

In a preferred embodiment, the method provides for a recess within the appliance housing that mates to a shape of the control panel housing such that the control panel is moveable or rotatably insertable into the recess and/or pivoting the control panel into the recess in the appliance housing prior to transporting the appliance housing.

These and other objectives, features, and advantages of the present invention will become apparent from the drawings, the descriptions given herein, and the appended claims. However, it will be understood that above-listed objectives of the invention are intended only as an aid in understanding aspects of the invention, are not intended to limit the invention in any way, and therefore do not form a comprehensive or restrictive list of objectives, and/or features, and/or advantages of the invention.

BRIEF DESCRIPTION OF DRAWINGS

For a further understanding of the nature and objects of the present invention, reference should be had to the following detailed description, taken in conjunction with the accompanying drawings, in which like elements may be given the same or analogous reference numbers and wherein.

While the present invention will be described in connection with presently preferred embodiments, it will be understood that it is not intended to limit the invention to those embodiments. On the contrary, it is intended to cover all alternatives, modifications, and equivalents included within the spirit of the invention.

GENERAL DESCRIPTION AND PREFERRED MODES FOR CARRYING OUT THE INVENTION

Figure 1:
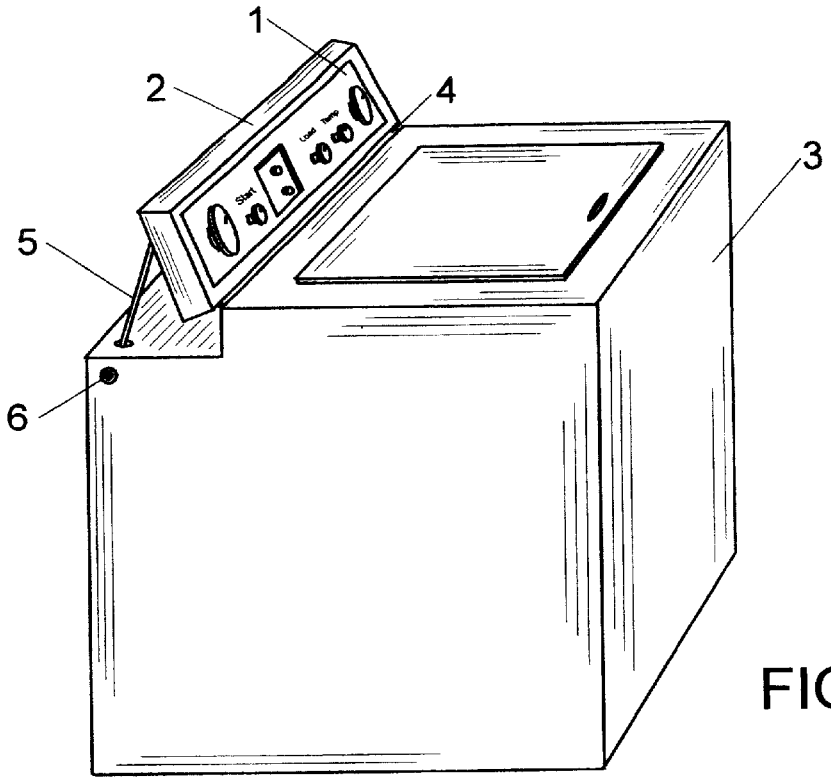
FIG. 1 is perspective view of a typical laundry machine with a control panel and housing in accord with the present invention.

Now referring to the drawings, and more particularly to FIG. 1, there is shown a presently preferred embodiment of the invention which may comprise control panel 1 mounted to housing 2, which is attached to appliance 3 by flexible or pliable member 4. Flexible member 4 may be fabricated from any of a number of materials such as rubber, synthetic elastomer, plastic, thin metal, or a combination thereof, to allow a bending action adequate to permit the required range of movement of housing 2 with respect to appliance 3. The inventor considers mechanical pivots for a control panel, as used in the prior art, to be problematic in the presence of long term significant vibration as may typically be produced by appliances and/or other machines such as, for instance, clothes washers, clothes dryers, and other vibrating equipment. Any looseness or play between the pivot mechanism can produce an amplification effect, increasing the shock and vibration exposure of components mounted in the control panel. In addition, such looseness or play can produce objectionable audible noise, during vibration. Moreover, flexible member 4 may be utilized to support housing 2 preferably along the entire length or base or at least most of the length thereof with respect to appliance body 3 rather than simply at particular points thereof to thereby provide increased mechanical support as compared to one or more pivot connections. In one embodiment, flexible or pliable member 4 may be a strip with a length substantially longer width whereby the length may range from three to twenty or more times the width depending on the various sizes of the control panel housing 2. Flexible or pliable member 4 may be secured to control panel housing 2 and to appliance housing 3 by any suitable means including glue, rivets, screws, fasteners of any type, clamps, pins, and the like, welded, soldered, molded, extruded, or mechanically captured.

Figure 2:
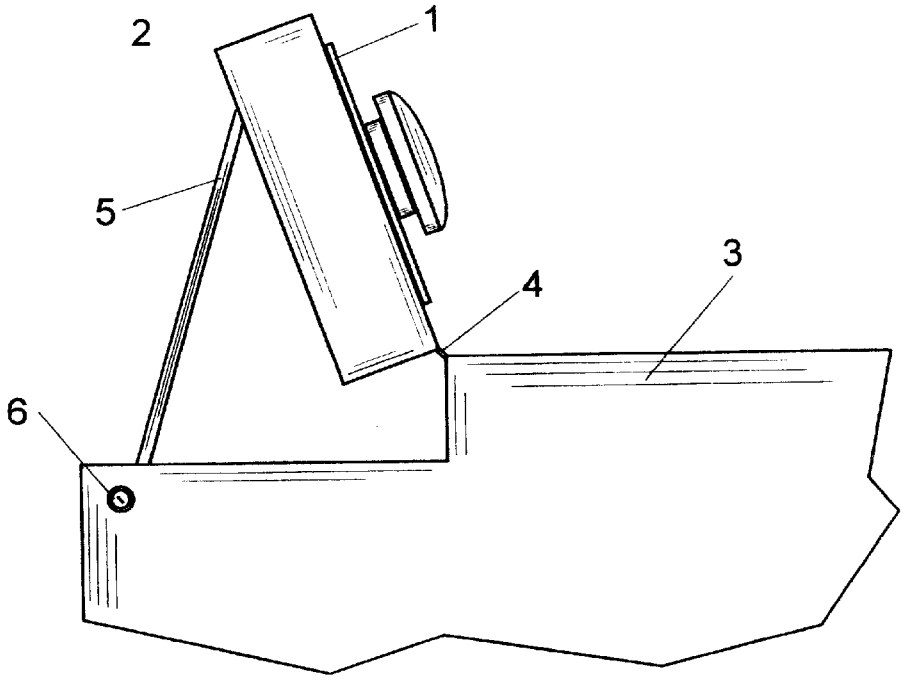
FIG. 2 is an enlarged elevational view of the machine of FIG. 1 showing the flexural attachment between the control panel housing and the remainder of the appliance and the support and clamping members.
Figure 3:
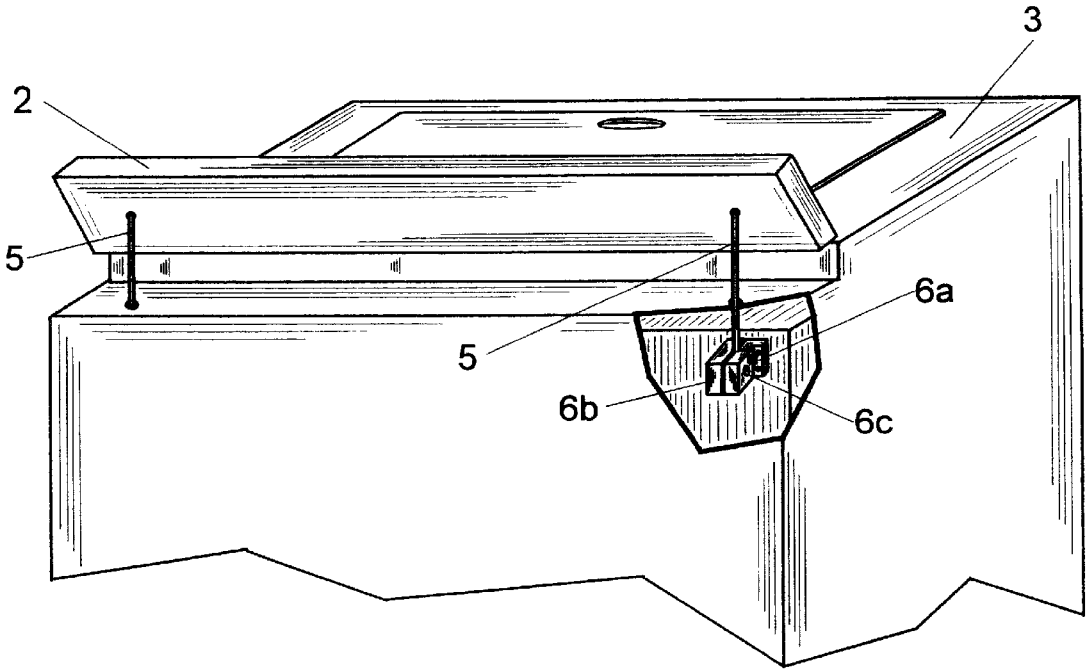
FIG. 3 is an elevational view, from the rear, showing a detailed view of some support/clamping members for a control panel in accord with the present invention.
Figure 4:
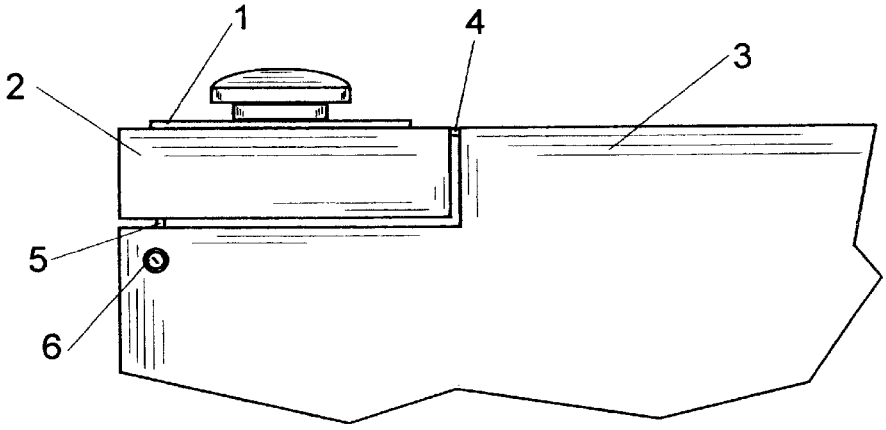
FIG. 4. is an enlarged elevational view of the machine of FIG. 2, with the control panel housing moved to a prone position for shipping.

At least one, but preferably a plurality of support members 5 as shown more clearly in FIG. 2, FIG. 3, and FIG. 4, reliably support housing 2 at any user-determined angle even in the presence of extensive vibration. Another problem with prior art pivotal panels, as determined by the inventor, is that operators such as housewives and the like, may tend to apply significant pressure to the control panel in pressing buttons and utilizing other control features. For instance, while a control button may require only a few ounces of pressure to operate, many operators may apply five to ten pounds of pressure to the button. In prior art panels, this over pressure may cause the entire panel to rotate to an undesirable angle thereby frustrating operation and causing numerous problems and delays. In the present invention, the use of one or more support members 5 provides more than enough support so that control panel housing 2 is affixed in position so long as that position is desired. Applied over pressure will not cause the panel housing 2 to rotate in the present invention. Moreover, vibration will not reduce the support provided by rigid support members 5.

Support member 5 may comprise a rod, bar, plate, other structural shape, or a combination thereof, and may be fabricated from plastic, metal, or other suitable structural materials. It should be noted that although a single support member 5 may be adequate in some cases, many applications may employ multiple support members for additional strength and stability. Support member 5, which may be a rod or other structure, may also have notches, ridges, grooves, or other means provided thereon to increase frictional grip to retain and hold support member 5 for long term stability of operation. The thickness of support member(s) 5 may be varied as desired for the application.

FIG. 2 shows additional detail of flexible member 4 and support member 5 and also shows clamp 6. Support member 5 and clamp 6 may be utilized to determine the position of housing 2 and therefore the angle of control panel 1, with respect to appliance 3. Clamp 6 may be utilized to selectively clamp or rigidly affix support member 5 by clamping at any selectable position along the length of support member 5. Alternatively, clamp 5 may unclamp or release support member 5 so that support member 5 and housing 2 are relatively moveable with respect to clamp 6. Clamp 6 is attached to appliance 3 and arranged so as to allow the operator to release its clamping action, thus allowing the angle of housing 2 to be adjusted with respect to the position of appliance 3, through the bending action of flexible member 4. Clamp 6 may then be re-engaged, retaining housing 2 and thereby control panel 1 at a desired angle. Thus, a method of operation may include a step such as connecting control panel 1 to housing 2 such that control panel 1 may be moved to any angle with respect to appliance housing 2 within an angular range.

Clamp 6 may comprise any of a number of suitable types of clamps that are commercially available, or may be a custom fabricated clamp to meet particular requirements of the designer. As shown in FIG. 3, one presently preferred clamp base 6*a* is mounted to appliance 3. One presently preferred clamp comprises cleat 6*b* that grips support member 5 in response to pressure exerted by presently one preferred clamp screw 6*c*, thus retaining support member 5 in the position required to hold housing 2 and control panel 1 at the desired angle. It will be understood that many types of clamps with varying types of clamp elements could be utilized to perform these same functions.

In the case of multiple support members 5, such as that shown in FIG. 3 wherein two support members 5 are utilized, a corresponding number of clamps 6 will typically be employed, which may be of the same or differing characteristics, as best suit the particular application. Although clamp 6 is shown mounted externally to appliance 3, clamp 6 could be mounted internally such that support member 5 extends into a hole, guide, or passageway that leads support member 5 past clamp 6 such that clamp 6 may be utilized to clamp or unclamp support member 5. Clamp 6 may be operated with levers, strap down elements, locks, spring loaded elements, and other components for securely and conveniently clamping and locking support member 5 in position, preferably for a relatively low cost. Support member 5 may be pivotally attached at one end to control panel housing 2. However, if desired, support member 5 could be rigidly affixed to control panel housing 2 with a suitable shape and design to permit clamping thereof within the resulting defined path of movement of support member 5 as control panel housing 2 moves or rotates with respect to appliance 3. For instance, support member 5 and clamp 6 could effectively provide a rack and pinion connection whereby clamp 6 comprises gears to engage respective grooves. The gears may be then be locked when control panel housing 2 is positioned at the desired angle.

Referring to FIG. 4, it can be seen that an additional feature of one preferred embodiment of the present invention is a recess in appliance housing 3 that mates to the shape, of control panel housing 2. In this case, control panel housing 2 is substantially rectangular, but other shapes could also be utilized. In a preferred embodiment, the recess of appliance housing 3 is provided with sufficient space therein such that control panel housing 2 and control panel 1 may be moved to a prone position. This allows the volume of appliance 3 to be minimized for packaging, shipping, and warehousing purposes, with resulting savings in space and cost.

The foregoing disclosure and description of the invention is therefore illustrative and explanatory of a presently preferred embodiment of the invention and variations thereof, and it will be appreciated by those skilled in the art, that various changes in the design, organization, order of operation, means of operation, equipment structures and location, methodology, the use of mechanical equivalents, as well as in the details of the illustrated construction or combinations of features of the various elements may be made without departing from the spirit of the invention. As well, the drawings are intended to describe the concepts of the invention so that the presently preferred embodiments of the invention will be plainly disclosed to one of skill in the art but are not intended to be manufacturing level drawings or renditions of final products and may include simplified conceptual views as desired for easier and quicker understanding or explanation of the invention. As well, the relative size and arrangement of the components may be greatly different from that shown and the invention will still operate well within the spirit of the invention as described hereinbefore and in the appended claims. Thus, various changes and alternatives may be used that are contained within the spirit of the invention. For instance, although a flexible member is the preferred connector, and while hinges are not preferred, nonetheless a hinge might be utilized in certain embodiments of the invention such as where a recess is provided in appliance housing 2 whereby the control panel is rotatable, angularly rotatable into the recess. As well, clamped support members 5 provide a unique and sturdy mechanism to selectively move or rigidly support control panel 1 in any position with any type of connection although the preferred connection is a flexible member.

Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative of a presently preferred embodiment and not in a limiting sense.

What is claimed is:

1. An appliance assembly, comprising:

an appliance housing;

a control panel housing; and at least one pliable member having a first side and a second side, said first side being affixed to said appliance housing and said second side being affixed to said control panel housing such that said control panel housing is moveable with respect to said appliance housing, said at least one pliable member being elongate and being affixed to most of a length of said control panel housing.

2. The assembly of claim 1, further comprising:

at least one support member mounted between said control panel housing and said appliance housing operable for affixing said control panel housing at a desired position with respect to said appliance housing.

3. The assembly of claim 2, wherein said at least one support member is pivotally attached to said control panel housing.

4. The assembly of claim 2, further comprising:

at least one clamp, said at least one clamp being operable for clamping said at least one support member in a selected position to thereby affix said control panel at said desired position.

5. The assembly of claim 4, wherein said at least one clamp is secured to said appliance housing.

6. The assembly of claim 1, further comprising:

said appliance housing defining a recess adjacent said pliable member, and said control panel having a selected shape to mate with said recess such that said control panel housing is moveable into said recess for reducing a total volume of said combined appliance housing and control panel housing.

7. A method for mounting a control panel housing with respect to an appliance housing, comprising:

connecting said control panel housing to said appliance housing such that said control panel may be moved to any angle with respect to said appliance housing within an angular range;

providing a recess within said appliance housing that mates to a shape of said control panel housing such that said control panel is insertable into said recess;

providing a control that either permits movement of said control panel housing with respect to said appliance housing or affixes said control panel in a selectable position with respect to said appliance housing;

providing one or more support members attachable between said control panel housing and said appliance housing to rigidly suport said control panel housing in said selected position; and providing one or more clamps for selectively gripping said one or more support members.

8. The method of claim 7, wherein said step of connecting further comprises:

attaching a first side of a pliable member to said control panel housing, and attaching a second side of said pliable member to said appliance housing.

9. The method of claim 7, further comprising:

providing said pliable member to be elongate in that said pliable member has a width less than one-fifth of its length.

10. The method of claim 7, further comprising:

affixing said one or more clamps to said appliance housing.

11. The method of claim 7, further comprising:

providing a pivotal connection on a first end of said one or more support members.

12. A method for selectively and securely controlling a position of a control panel housing with respect to an appliance housing which vibrates during operation, comprising:

connecting said control panel housing to said appliance housing such that said control panel may be moved to any selected angle with respect to said appliance housing within an angular range;

providing one or more support members attachable between said control panel housing and said appliance housing to rigidly support said control panel housing in said selected position;

providing one or more clamps for selectively gripping said one or more rigid members; and affixing said one or more clamps to said appliance housing.

13. The method of claim 12, wherein said step of connecting further comprises:

attaching a first side or a pliable member to said control panel housing, and attaching a second side of said pliable member to said appliance housing.

14. The method of claim 12, further comprising:

providing said pliable member to be elongate in that said pliable member has a width less than one-fifth of its length.

15. The method of claim 12, wherein said first and second sides of said pliable member are opposite sides of said width of said pliable member.

16. The method of claim 12, further comprising:

providing a recess within said appliance housing that mates to a shape of said control panel housing such that said control panes is insertable into said recess.

17. The method of claim 16, further comprising:

moving said control panel into said recess in said appliance housing prior to transporting said appliance housing.

* * * * *